United States Patent [19]

Fury

[11] Patent Number: 4,841,896

[45] Date of Patent: Jun. 27, 1989

[54] BEACH SUBMARINE

[76] Inventor: Tommy J. Fury, 1613 Colonial Pkwy., Clovis, N. Mex. 88101

[21] Appl. No.: 186,355

[22] Filed: Apr. 26, 1988

[51] Int. Cl.[4] ..... B63G 8/41

[52] U.S. Cl. ..... 114/312; 114/121; 114/330; 114/314

[58] Field of Search ..... 114/61, 123, 66, 314, 114/317, 330–333, 337, 338, 312

[56] References Cited

U.S. PATENT DOCUMENTS

| | | | |
|---|---|---|---|
| 566,766 | 9/1896 | James | 114/330 |
| 3,092,060 | 6/1963 | Reid | 114/333 |
| 3,183,871 | 5/1965 | Reder | 114/332 |
| 4,333,414 | 6/1982 | Hauz | 114/333 |
| 4,411,213 | 10/1983 | Laukien | 114/333 |

*Primary Examiner*—Joseph F. Peters, Jr.
*Assistant Examiner*—Edwin L. Swinehart
*Attorney, Agent, or Firm*—Wendell Coffee

[57] ABSTRACT

A submarine includes a body and two ballast tanks. The ballast tanks are moveable from an up or diving configuration to a down or beach configuration. With the ballast tanks in the diving configuration and full of water, the submarine normally floats awash, and can be caused to dive at shallow depths for sight-seeing. With the ballast tanks full of air and in the beach configuration, the body will float substantially out of water, and the submarine may be beached or brought to a wharf for easy boarding or debarkation. In the diving configuration, the submarine is identical above and below a horizontal central plane.

8 Claims, 3 Drawing Sheets

BEACH SUBMARINE

RIGHTS TO INVENTIONS UNDER FEDERAL RESEARCH

There was no federally sponsored research and development concerning this invention.

BACKGROUND OF THE INVENTION (1) Field of the Invention

This invention relates to underwater pleasure crafts. One having ordinary skill in the art is a person skilled in building small boats and submarines for recreational purposes.

(2) Description of the Related Art

Until very recent times, all submarines were for military purpose. Although fictional works had described submarines used for recreational, pleasure, or exploration, applicant is unaware of any such submarines actually constructed more than 30 years ago.

Normally, submarines are larger crafts carrying 25 men or more. Although small military submarines carry only one or two men were used by the Japanese during World War II, the technology concerning them was not well known in the United States.

In recent times a limited number of small submarines were built for use in off shore oil fields.

In recent times, there has been constructed recreational or pleasure submarines in the United States. As used herein, application uses the words "pleasure submarines" to mean those submarines which are used for purposes of pleasure and sights seeing as opposed to military purposes.

BUJULAZ, U.S. Pat. No. 3,038,431 discloses a submergible boat having surface floats as seen in FIG. 4 of that patent. These floats are pivoted by arms to the main hull. However, applicant understands that these floats would never be filled with water so the floats themselves never submerge. It is applicant's understanding that the floats are always upon the surface, and the main hull can never be in deeper water than the length of the arms connecting the surface floats to the hull. BUJULAZ uses the floats and arms to limit the depth of the craft rather than use them to elevate the hull out of the water.

COLMAN, U.S. Pat. No. 4,276,851 is similar to BUJULAZ in that COLMAN discloses a service craft with arms from the surface craft that limits the downward decent of a separate capsule.

LEGAT, U.S. Pat. No. 2,918,029 discloses a military submarine for carrying torpedoes having pivoted legs. The legs disclosed in LEGAT support the craft when it is on the bottom of the lake and they are controlled by hydraulic cylinders.

SEELEY, U.S. Pat. No. 3,371,635 has a certain bubble shape.

SUMMARY OF THE INVENTION (1) Progressive Contribution to the Art

I have invented a sight-seeing submarine which is adapted to carry one or two persons at shallow depths. The submarine is for use by people having a minimum skill in submarines. I.e., it is contemplated that the submarine according to this invention may be used by tourist who have never before been in a submarine.

The submarine is easy and comfortable to board and debark. The cabin or the body of the submarine is small. The body is raised almost clear of the water to be comfortable to board and debark at a wharf. Furthermore, a submarine according to my invention is adapted to be beached in normal operations so that a person may board and debark the submarine while on the beach.

Ballast tanks are moveable on the submarine from a diving configuration to a beaching configuration.

When in the beaching configuration, the ballast tanks are full of air; and therefore, in a buoyant condition. When in this configuration, the tanks function as pontoons or floats. The ballast tanks have sufficient buoyancy so that the body of the submarine is nearly out of the water. However, in the diving configuration, the ballast tanks have sufficient water in them so that the entire craft would have near zero or equilibrium buoyancy; and therefore, the entire craft would be awash, and with a minimum amount of motion and proper control, it submerges and operates below the surface. To conserve energy desired that the hydrodynamics of the craft in the diving configuration be such that the majority of the propulsion force moves it in a forward direction. A very minimum amount of energy is necessary to cause the submarine to dive or surface.

The outer shape or configuration of the craft in the diving configuration is the same above and below the center line of the craft. I.e., the bottom closure of the craft has the same configuration as the canopy of the Craft. Both the bottom closure and the canopy are made of transparent material such as Plexiglas; therefore giving a maximum visibility for the enjoyment of the occupants. For ease of construction, the canopy and the bottom closure are identical, and that the bottom closure would be attached in a fixed position to the frame of the craft, while the canopy is hinged so that occupants can board and debark.

Submarines are well known; and therefore, the controls which would always maintain a positive buoyancy for the craft and also other features of the craft are well known, and it is only those features which are unique to this particular craft are described in detail.

(2) Objects of this Invention

An object of this invention is to provide a safe pleasant trip for people to travel and sight see underwater.

Another object is to provide a craft which can be beached or readily elevated at a wharf for easy boarding and debarkation.

Further objects are to achieve the above with devices that are sturdy, compact, durable, lightweight, simple, safe, efficient, versatile, ecologically compatible, energy conserving, and reliable, yet inexpensive and easy to manufacture, operate and maintain.

Other objects are to achieve the above with a method that is rapid, versatile, ecologically compatible, energy conserving, efficient, and inexpensive, and does not require highly skilled people to operate, and maintain.

The specific nature of the invention, as well as other objects, uses, and advantages thereof, will clearly appear from the following description and from the accompanying drawing, the different views of which are not scale drawings.

Figure 1:
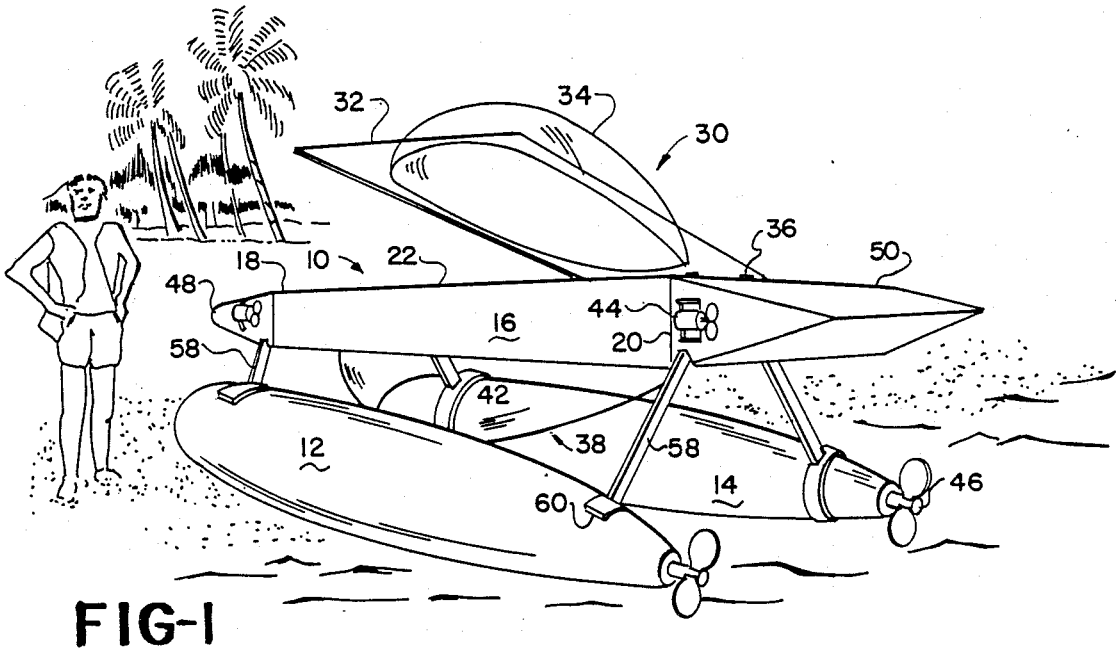
FIG. 1 is a perspective view of the craft according to this invention in the beached configuration with the oanopy in the open position.

As an aid to correlating the terms of the claims to the exemplary drawing, the following catalog of elements and steps is provided:

body
port ballast tank
starboard ballast tank
frame
front portion
rear portion
flat top
flat bottom
center plane
top canopy
flat edge
protrusion
hinges
bottom closure
flat top edge
protrusion
body propulsion means
ballast tank propulsion means
nose portion
tail portion
flood means
shaft
ends
strut
saddle
crank
hydraulic cylinder
plate
crank
tie rod
bell crank
pivot

DESCRIPTION OF THE PREFERRED EMBODIMENT

As may be seen in the drawings, the craft has three main elements: body 10, which might also be called the cabin or the hull, and the two ballast tanks, port ballast tank 12 and starboard ballast tank 14. The ballast tanks might also be called pontoons.

The body 10 has rectangular frame 16. The body frame 16 has front portion 18, rear portion 20, flat top 22, flat bottom 24, and horizontal center plane 26 shown as a broken line in the drawings in FIGS. 2, 3, and 5. The plane 26 is a horizontal plane through the center of the frame 16 and body 10.

The body 10 has an outer shell . This will be the shell that contacts the water when the craft is submerged.

Figure 5:
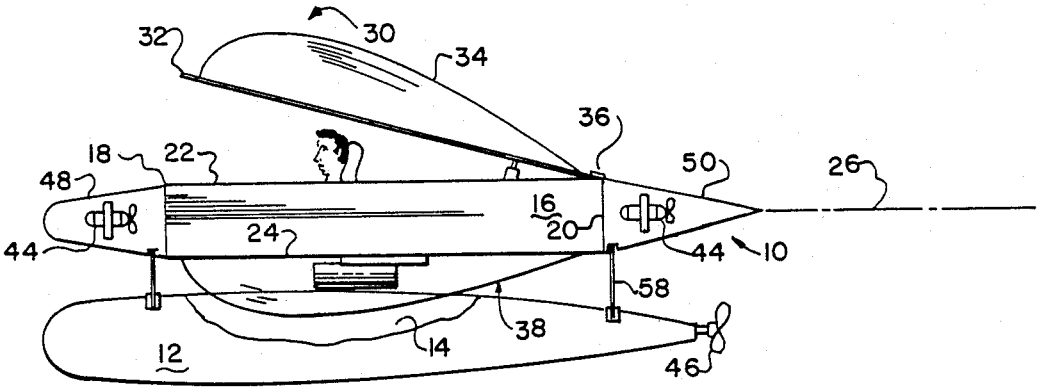
FIG. 5 is a side elevational view of the craft in the beach configuration with the canopy partially open and the port ballast tank partially broken away.
Figure 6:
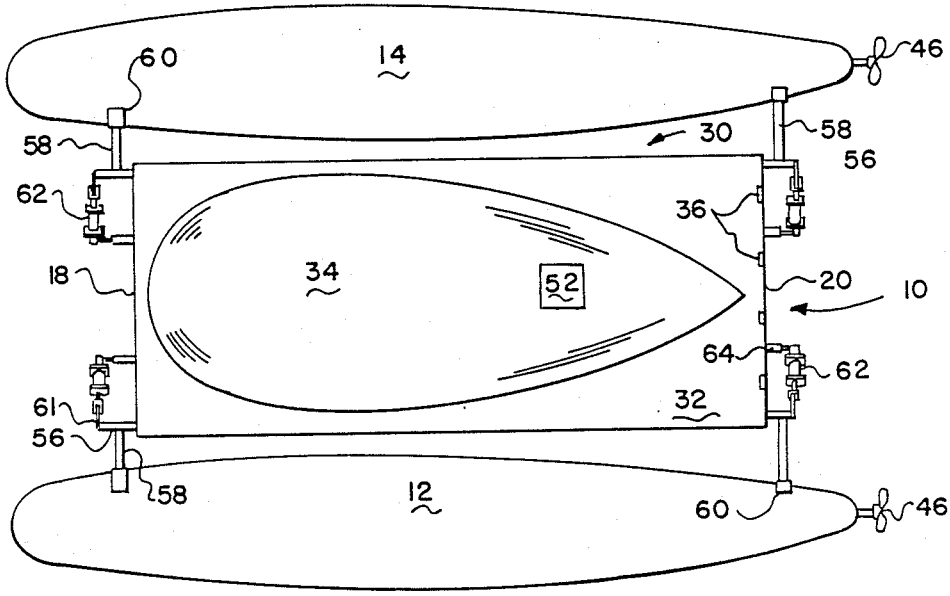
FIG. 6 is a top plan view of the craft in the diving beach configuration with the nose and tail portions removed and the coordinating means not show for clarity.

Top canopy 30 has planer circumferential edge 32 with bubble or protrusion 34 (FIGS. 5 and 6, particularly). The canopy is connected by hinges 36 to the flat top 22 of the frame 16 at the rear portion 20. The canopy is clamped to the flat top 22 when it is in the driving configuration. The flat edge 32 of the canopy will seal against the flat top 22 of the frame. Inasmuch as clamps, seals, gaskets, and the like are all well known to the art, they are not described in detail. The top canopy 30 is made of clear plastic material so that the occupants of the submarine may clearly see the sights.

Figure 3:
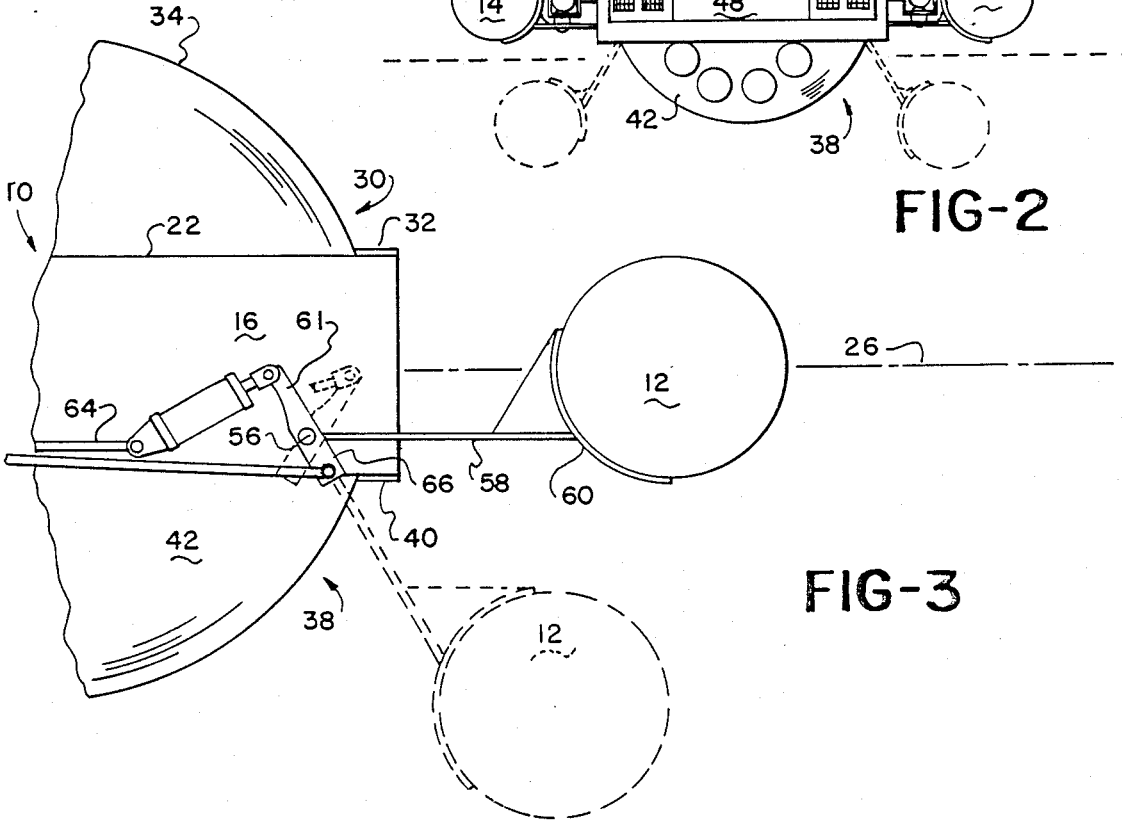
FIG. 3 is a front elevational detail view with the nose portion removed showing the mechanism by which the ballast tanks are moved from the diving configuration to the beach configuration.
Figure 4B:
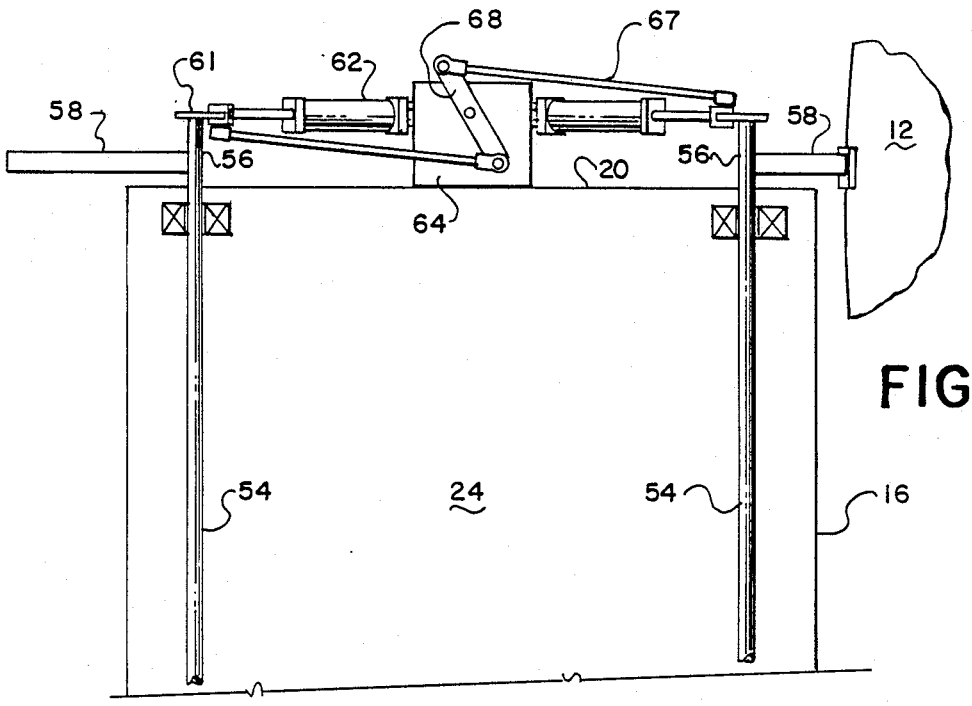
FIG. 4B is a schematic bottom plan view of the coordinating means in the beach configuration.
Figure 4D:
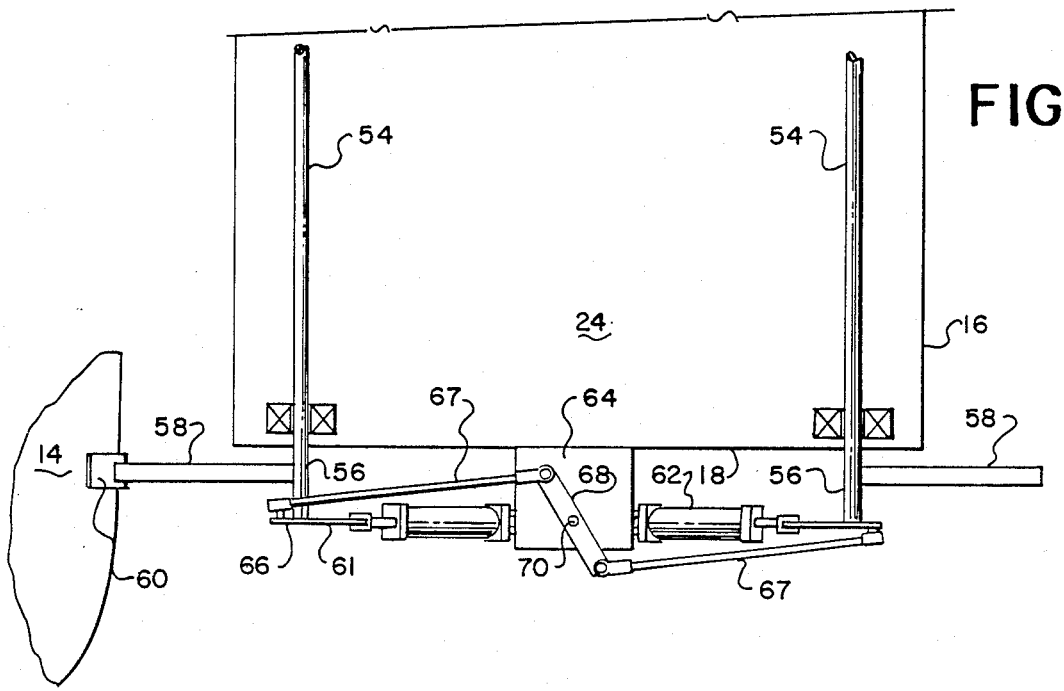
FIG. 4D is a schematic bottom plan view of the coordinating means in the dive configuration.

The bottom closure 38 is identical, or nearly so, to the top canopy 30. It has flat peripheral edge 40 and protrusion 42 (FIG. 3). It is securely attached to the flat bottom 24 of the frame 16. By securely attached, it is meant that it can be removed at a repair facility for whatever reasons desirable. However, except for repairs or maintenance, in the day to day operation, it would remain attached.

Since the top canopy 30 is identical to the bottom closure 38, this maintains the body 10 as being identical on either side of the horizontal plane 26. The body has nose portion 48 which extends from the front portion 18 of the body frame 16. The body has tail portion 50 which extends from the rear portion 20. The nose portions and tail portions are not water tight because of the different mechanisms which are mounted therein and the movement that these mechanisms will have.

A plurality of body propulsion means 44 are attached to the nose and tail portions 48 and 50.

I prefer that they take the form of an electric motor with a propeller attached directly to the shaft of the electric motor. However, it will be understood that they could also be propelled by hydraulics, electrical energy carried by batteries within the submarine being transformed to hydraulic fluid under pressure. The propulsion means 44 are centered on the horizontal plane 26 of the frame. As illustrated, there are four motors, one at each corner.

Also, these motors and propellers of the propulsion means 44 are mounted for articulation so that may, instead of always going straight ahead, be pointed up or down, thereby causing the submarine to dive or to climb. Also, by controls, they could be used to turn the submarine. Inasmuch as the maneuvering of the submarine and the angling of the propulsion means units are well known, they are not described in detail. Ballast tank propulsion means 46 are mounted upon the rear of each of the ballast tanks 12 and 14.

Figure 2:
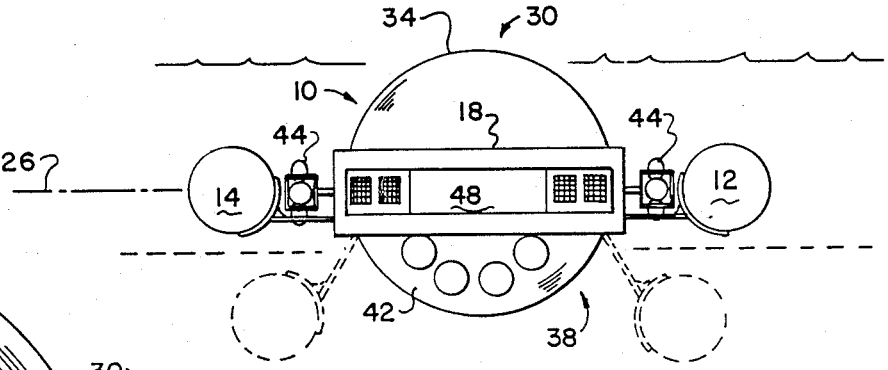
FIG. 2 is a front elevational view of the craft in the diving configuration with the ballast tank shown in the beached configuration in phantom line and also an indication of where the water line would be when in the diving and beached configuration.

The ballast tanks 12 and 14 are similar. Each will have an axis, and each will have a circular cross section around the axis. As seen in FIGS. 2 and 3, when the craft is in the diving configuration, the axis of the ballast tanks will be on the center plane 26 of the body 10.

As shown schematically in FIG. 6, flood means 52 are at least partially within the body 10 to flood and blow or evacuate the ballast tanks 12 and 14. The flood means include tubes or hoses from the body to the ballast tank. The hoses have not been shown, as well as details of the way the ballast tanks would be flooded and blown or emptied, inasmuch as flooding and blowing ballast tanks is well known to the art.

From the description, it will be understood when the craft is in the diving configuration with the ballast tanks on the center plane of the body, the craft is substantially identical above and below the center plane 26 so that the submarine moves under water in the diving configuration and tends neither to float or sink because of its movement through the water. Those having skill in the art will understand that the craft would be designed to have a slight positive buoyancy so that in any event, the craft would float to the surface. To cause lhe craft to dive, body propulsion means 44 are manipulated.

Port and starboard shafts 54 run within the frame 16 on either side near the lower portion or the near the bottom 24 thereof. The shafts 54 are journaled for rotation. Ends 56 of the shaft 54 protrude forward of the frame 16 into the nose portion 48 and aft of the frame into the tail portion 50. On each end portion 56, strut 58 extends outward to be securely attached to the ballast tank by suitable saddle 60. Therefore, it may be seen that by rotating the shafts, the ballast tanks 12 and 14 may be moved from a lower or beach position to an upper or diving position or configuration.

The shafts 54 are rotated by power crank 61 attached forward of the front 18 and rearward of the rear 20. Hydraulic cylinders 62 extend from plate 64 on the frame 16 to the crank 61. Four hydraulic cylinders 62 are preferred, one on the front and rear of each shaft 54.

It is desirable that the port ballast tank 12 and the starboard ballast tank 14 be in the same position relative to the body 10. This is achieved by connecting a coordinating means between the two shafts 54. The coordinating means include second crank 66 extending diametrically opposed of the shaft end 56 to the power crank 61. The tie rod 67 is connected to the outer end of the crank 66. The tie rod 67 from the port and the starboard are connected to coordinating bell crank 68. The bell crank 68 is pivoted by pivot 70 at its center to the plate 64 which extends outward from the frame 16 within the nose portion 48 and the tail portion 50. Therefore, it may be seen that with two tie rods connected to the bell crank 68 that this will at all times cause the shafts 54 to rotate in the same amount which means that the ballast tanks 12 and 14 will always be in the same position relative to the center plane 26 of the body 10.

It will be understood that when the craft is in the beach configuration that it does not necessarily mean that it will be on the beach. It could be in the water, and at that time the tanks will basically have sufficient buoyancy when they have no water therein so that the body 10 substantially floats out of the water. The phantom water line of FIG. 2 illustrates this condition. The lower portion of the body 10 will be in the water; and therefore, the complete buoyancy will not be dependent upon the ballast tanks. It will be understood that the volume of both ballast tanks 12 and 14 will be slightly less than the volume of the body shell.

It will also be understood that with the ballast tanks in the beach position that the craft could be brought to a wharf so that people could board and debark at a wharf, or the craft could be run up onto a beach.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. The process involving a submarine having:

a. a body with
  i. a horizontal center plane,
  ii. a top canopy, and
    iii. a bottom closure, whereby people may ride therein, b. a ballast tank on each side of the body,

WHEREIN THE IMPROVEMENT COMPRISES:

c. positioning the ballast tanks at the center plane, d. filling the ballast tanks with water, thereby e. putting the submarine in a diving configuration so that the submarine may dive below the surface of the water, then f. removing the water from the ballast tanks so that the submarine floats on the surface of the water, and further g. removing substantially all the water from the ballast tanks, and h. moving the ballast tanks to a position below the body so that the body of the submarine is elevated substantially above the water and the two ballast tanks function as pontoons to hold the body in a beach configuration.

2. A submarine comprising in combination:

a. a body having a top canopy and a bottom closure member, b. said body having a horizontal central plane, c. a cylindrical ballast tank having and axis mounted on each side of the body on the center plane when in diving configuration, d. flood means at least partially on the body for flooding and blowing the ballast tanks, e. the ballast tanks having a beach configuration in which the ballast tanks are substantially lower than the body, and f. strut means interconnecting the body and the ballast tanks for positioning the ballast tanks in either the diving configuration or the beach configuration.

3. The invention as defined in claim 2, further comprising:

g. propulsion means mounted on the body.

4. The invention as defined in claim 2, wherein said strut means includes:

g. a shaft extending on each side of the body, h. struts rigidly attached to the shaft and extending to the ballast tanks, i. said struts rigidly connected to the ballast tanks, j. at least one crank arm rigidly attached to the shaft, k. a hydraulic cylinder extending from the body to the crank arm whereby expansion and contraction of the hydraulic cylinder causes rotation of the shafts and movement of the ballast tanks back and forth from the diving configuration to the beach configuration.

5. The invention as defined in claim 4, further comprising:

1. coordinating means connecting the two shafts so that the two ballast tanks are in the same position from diving configuration to beach configuration.

6. The invention as defined in claim 5, further comprising:

m. propulsion means mounted on the body.

7. A submarine comprising in combination:

a. a body frame having
  i. a front portion,
  ii. a rear portion,
  iii. a flat top,
  iv. a flat bottom, v. a horizontal center plane, and vi. an outer shell, b. said outer shell having substantially the same shape above and below the center plane, c. a top canopy hinged to the rear portion of the flat top of the body, and clamped water tight to the flat top when in diving configuration, d. a bottom closure having substantially the same shape as the top canopy attached to the flat bottom of the body, e. propulsion means mounted to the body on the center plane, f. an elongated ballast tank having an axis mounted on each side of the body on the center plane when in diving configuration, g. flood means at least partially on the body for flooding and blowing the ballast tanks, h. when in the diving configuration the outer configuration of all the structure recited above being substantially identical above and below the center plane so that when the submarine moves under the water in the diving configuration that tends neither to float nor sink because of its movement in the water.

8. The invention as defined in claim 7, further comprising:

i. the ballast tanks having a beach configuration in which the ballast tanks are substantially lower than the body, and j. struts means interconnecting the body and the ballast tanks for positionig the ballast tanks in either the diving configuration or beach configuration.

* * * * *